United States Patent [19]

Lindsey et al.

[11] Patent Number: 4,828,037

[45] Date of Patent: May 9, 1989

[54] LINER HANGER WITH RETRIEVABLE BALL VALVE SEAT

[75] Inventors: Hiram E. Lindsey, Midland; Roger P. Allwin, College Station; Richard W. Adams, Bryan, all of Tex.

[73] Assignee: Lindsey Completion Systems, Inc., Midland, Tex.

[21] Appl. No.: 191,578

[22] Filed: May 9, 1988

[51] Int. Cl.[4] ..... E21B 23/04; E21B 34/10

[52] U.S. Cl. ..... 166/382; 166/212; 166/238; 166/239; 166/317; 166/328; 166/386

[58] Field of Search ..... 166/237–239, 166/316–319, 321, 325–328, 332, 120, 212, 117, 382, 386

[56] References Cited

U.S. PATENT DOCUMENTS

| | | | |
|---|---|---|---|
| Re. 31,881 | 5/1985 | Lindsey, Jr. | 166/208 X |
| 3,136,364 | 6/1964 | Myers | 166/212 |
| 3,189,095 | 6/1965 | De Rochemont | 166/120 |
| 3,211,226 | 10/1965 | Myers et al. | 166/120 |
| 3,239,009 | 3/1966 | Leutwyler | 166/120 |
| 3,306,365 | 2/1967 | Kammerer, Jr. | 166/318 |
| 4,510,994 | 4/1985 | Pringle | 166/317 X |
| 4,512,406 | 4/1985 | Vann et al. | 166/318 X |
| 4,712,614 | 12/1987 | Allwin et al. | 166/217 X |
| 4,729,432 | 3/1988 | Helms | 166/317 |

FOREIGN PATENT DOCUMENTS

| | | | |
|---|---|---|---|
| 1087 | 12/1979 | World Int. Prop. O. | 166/120 |

OTHER PUBLICATIONS

The P-1 Landing Sub of Texas Iron Works (TIW), p. 6133 of Lee 1986–1987 "Composite Catalog of Oil Field Equipment & Services".

*Primary Examiner*—Hoang C. Dang

[57] ABSTRACT

In a hydraulically operated setting tool for liner hangers used in a well bore, a norally countracted ball seat formed in the setting tool mandrel by contracted and elongated finger members. Upon seating a ball member in the ball seat, applied pressure is used to set the hydraulic setting tool. After setting the hydraulic setting tool, the ball seat is longitudinally movable so that the finger members can expand to a full opening condition in a recess and release the ball member and so that the finger members are also retrievable with the setting tool.

5 Claims, 2 Drawing Sheets

LINER HANGER WITH RETRIEVABLE BALL VALVE SEAT

FIELD OF THE INVENTION

This invention relates to methods and setting tool apparatus for liner hangers used in well bores, and more particularly, to methods and setting tool apparatus for hydraulically setting a liner hanger using a contracted ball valve seat in the setting tool where the ball valve seat is selectively expandable for providing a larger opening for passing other well tool components through the expanded ball valve seat and where the ball valve seat is retrievable with a setting tool.

BACKGROUND OF THE PRESENT INVENTION

In the completion of oil and gas wells, the practice is to drill a well bore from the earth's surface, insert a tubular steel casing in the well bore and fill the annulus between the casing and well bore with a cement slurry which sets and supports the casing in the well bore. Thereafter, a deeper section of well bore is drilled with a smaller diameter than the diameter of the surface casing. The drilling bit is removed from the deeper section of the well bores and a liner (which is a string of connected lengths of tubular, steel pipe joints), is lowered through the surface casing and into the open section of the well bore. The liner at its upper end is attached to a liner hanger which is releasably attached to a setting tool on the lower end of a string of drill pipe. The drill pipe supports the weight of the liner on the setting tool as the setting tool and liner are lowered into the well bore. The length of the liner is predetermined so as to have its lower end proximate to the bottom of the open well bore with its upper end section and an attached liner hanger overlapping the lower end of the section of casing above. The setting tool is operated to set slips on the liner hanger against and in gripping engagement with the casing so that the liner is "hung" or suspended in the open well bore by the slips in the lower end of a casing or pipe. With a hydraulically operated setting tool, the slips are set by dropping a check valve ball into the string of drill pipe so that the ball or plug is pumped or falls into a ball valve seat to close off the bore of the pipe at a location below the setting tool. Next, by building up hydraulic pressure in the drill pipe, the slips are set by the hydraulically operated mechanism in the setting tool. Thereafter, by increasing the pressure in the drill pipe, the ball valve seat is released to provide an open condition in the pipe below the setting tool so that cement slurry can be pumped through the liner for cementing an annulus.

Usually, the setting tool is released from the liner hanger prior to cementing. After the setting tool is released from the liner hanger, the exterior of the open pipe on the setting tool remains sealed off with respect to the bore of the liner so that a cement slurry can be pumped down the drill pipe through the open pipe and through the liner. At the lower end of the liner is a cementing shoe and back pressure valves (sometimes called cementing float equipment) and the slurry of cement is displaced by surface pumping equipment to flow through the cementing shoe and into the annulus between the liner and the open well bore. The cement slurry is displaced upwardly until the volume of cement in the annulus is at a desired level which is generally a level overlapping the top of the liner above. During this operation there is mud or control fluid in the well bore and mud or control fluid driving the cement slurry. Thus, when the cement slurry is introduced through the drill pipe it is generally followed by a cementing plug which wipes the internal surface of the drill pipe as it is moved through the drill pipe to minimize contaminating the cement slurry with mud or control fluid and to wipe the drill pipe. When the cementing plug reaches the setting tool it latches into a liner cement wiper plug (which is usually typically larger in diameter than the I.D. of the drill pipe) and the liner cement wiper plug and coupled cementing plug then follow the cement slurry. The liner cement wiper plug wipes the I.D. of the liner. The liner cement wiper plug stops when it bumps a landing collar or float equipment in the liner.

As noted above, in the setting operation for the liner hanger with a hydraulic setting tool, it is possible to drop a ball which seats in a ball valve seat at a valve seat location below a hydraulic actuating means in the setting tool. The valve seat location is usually in a specially constructed sub attached in the lower end of the liner just above the float equipment. In this type of valve seat, longitudinal movement of a sleeve opens a port or the pipe bore. The sub and valve are not retrieved and thus are consumable or expendable to the operation.

If a ball valve seat is located in the setting tool, release of the ball valve seat and ball is through the end of the setting tool pipe, and the attached wiper plug. In this case, the ball valve seat is not retrieved and becomes debris in the well bore and there is a risk of prematurely dislodging the wiper plug from the setting tool.

When the ball valve seat is located in a sub at the lower end of a liner, it is necessary to pressure up the entire liner to set a hydraulic setting tool. In any case, the ball valve seat assembly is an expensive consumable item and not reusable.

In another practice, a liner hanger and liner are lowered to the desired location and the liner is hung in a casing as above described with a valve seat in the setting tool. After the liner is hung, the setting tool and attached drill pipe are removed from the well bore prior to the cementing operation. Next, drill pipe with a polished mandrel at its lower end is lowered into the liner until the polished mandrel enters and seals with respect to a sealing bore located at the lower end of the liner. Typically, the sealing bore is part of the float collar or the float shoe. With this arrangement then, cement slurry can be pumped directly through a drill pipe and through the cementing equipment at the lower end of the liner neither contacting the internal bore of the liner nor imposing any pressure to the bore of the liner. However, as can be appreciated, this system requires two trips of a drill pipe, i.e., a first trip of drill pipe with a setting tool to hang the liner and a second trip of drill pipe with a polished surface mandrel to utilize the drill pipe in a sealed bore at the lower end of the liner.

In a co-pending application, Ser. No. 147,533, filed Jan. 25, 1988, and assigned to the assignee of the present invention, a method and apparatus is disclosed in which a liner is made up at the earth's surface in an appropriate length for a well bore. At the lower end of the liner is an internal sealing bore located just above the cement floating equipment. The liner when made up to the desired length and disposed in the well, is initially hung in casing slips at the earth's surface while a drill pipe is connected up joint by joint at the earth's surface and lowered into and through the liner. At the lower end of the drill pipe is a section of polished mandrel which is sized for sliding and sealing engagement within the internal sealing bore in the liner. Also disposed in a section of pipe at the lower end of the drill pipe is a lower ball check valve for operating a hydraulic setting tool and an upper cementing plug valve for opening a bypass in the drill pipe upon completion of the cementing injection. The drill pipe is made up in sections until the polished mandrel is stabbed or inserted into the sealing bore at which time a hydraulic setting tool and liner hanger are attached to the drill pipe and to the liner respectively so that the setting tool can support the liner hanger, the liner and the internal string of drill pipe within the liner. The surface casing slips are then released and a running-in string of drill pipe is made up by connecting drill pipe joints and the entire assembly of telescoped drill pipe and liner is lowered into the well bore to the desired location depth. At the desired location depth a trip ball or plug for the check valve is dropped and pumped through the drill pipe to seat in the lowermost ball check valve in the drill pipe so that a hydraulic pressure buildup can occur in the drill pipe for actuating the hydraulic setting mechanism in the setting tool. The setting tool then brings the slips of the liner hanger into setting engagement with the inner wall of the next above casing or pipe.

When the setting tool is actuated and the slips on the liner hanger are set, an increase or pressure buildup in the drill pipe causes the lower check valve to open a port and the valve is retained in the drill pipe while the lower end of the drill pipe is opened to the port. The setting tool is then disconnected from the liner hanger by release of a threaded nut coupling so that the supporting drill pipe is not connected to the liner hanger during the cementing operation and the polished mandrel at the lower end of the string of drill pipe remains in sealing relationship to the sealing bore in the liner. Thereafter, cement can be pumped down the drill pipe from the earth's surface through a drill pipe of substantially uniform internal diameter and the calculated volume of cement slurry can be followed by a cement wiper plug in the well-known manner. When the cement wiper plug engages the upper bypass valve in the liner, the bypass valve is opened so that the interior of the liner and the interior of the drill pipe are in fluid communication after the cementing operation is complete thereby relieving the drill pipe from retrieving any fluid when the drill pipe is removed. In this system it is necessary to pressure up the entire length of drill pipe which extends to the float equipment.

In any system, however, a particular problem arises when the end of the liner with a valve seat is located in a non-vertical location such as a deviated or horizontal section of well bore. In such instances it is extremely difficult and sometimes not possible to obtain seating of a ball or closure member in a small, centrally located valve seat opening at the lower end of a liner. Often if there is any question regarding operability under such conditions the equipment will not be used.

Some components which are utilized in the present invention have been used in a type P-1 landing sub available from TIW in Houston, Tex. The P-1 landing sub is shown on page 6447 of the 1978–79 "Composite Catalog of Oil Field Equipment & Services" and has a ball valve seat releasably coupled to a collar by a resilient ring. The resiliently expansible ring is normally held in a contracted position by a pressure responsive piston. When pressure is applied, the ring is released from the holding effect of the piston but is held in position by applied pressure on the ball valve. When the applied pressure is reduced on the ball valve, the ring unsnaps from or expands to release the ball valve seat so it can fall out of the collar.

Collet type valve seats have also been used in the past where the ball seats on relatively short upwardly directed collet fingers so that the collet fingers are under compression when the ball is seated on the fingers. A shear pin release permits a shift of the fingers to a location where the collet fingers are expanded to release the ball member. The collet fingers must be short and stubby to prevent crushing under compressive forces. Thus, the fingers have little resiliency and do not expand greatly and for a full opening, a large diameter ball is required. A large diameter ball raises the possibility of prematurely actuating a wiper plug when released. Also the pump down plug for the wiper plug must be larger than the ball diameter.

THE PRESENT INVENTION

The present invention is illustrated in a tubular valve sub which has an annular valve seat member slidably mounted in an annular recess in the valve sub. A resilient ring member releasably holds the valve seat member in an upper position where depending relatively long resilient finger members extend from an annular body and the finger members converge at terminal end portions to define a smaller opening for a valve seat which is a contracted valve seat. The defined opening of the valve seat has a distinctly smaller diameter than the diameter of the bore of the annular body. Thus, when a ball member is dropped into the ring member, the ball member is sized to close the opening of the valve seat so that hydraulic pressure can be applied to the closed valve to operate a hydraulic setting tool above. The application of pressure moves a piston member from a locking position to an unlocking position where the expandable resilient ring is released but the applied pressure on the ball member prevents the ring from an unlocking movement. Thus, the resilient ring member holds the valve seat in a fixed position until the applied pressure is reduced. When the applied pressure is reduced, the ring member releases itself from the valve seat member and expands so that the valve seat member can move downwardly to a lower location in the annular recess. In the lower location, the terminal end portions of the finger member are positioned adjacent to a second annular recess and the finger members resiliently respond to expand the terminal end portions into the second annular recess so that the inner diameter of the extended terminal portions and the attached finger members generally corresponds to the inner diameter of the annular body of the valve seat member. Thus a cementing plug can be passed through the finger members and the valve seat member is retrievable with the oil well tool. At the same time, the ball member can be made small enough to preclude premature operation of a wiper plug.

DESCRIPTION OF THE PRESENT INVENTION

Figure 1:
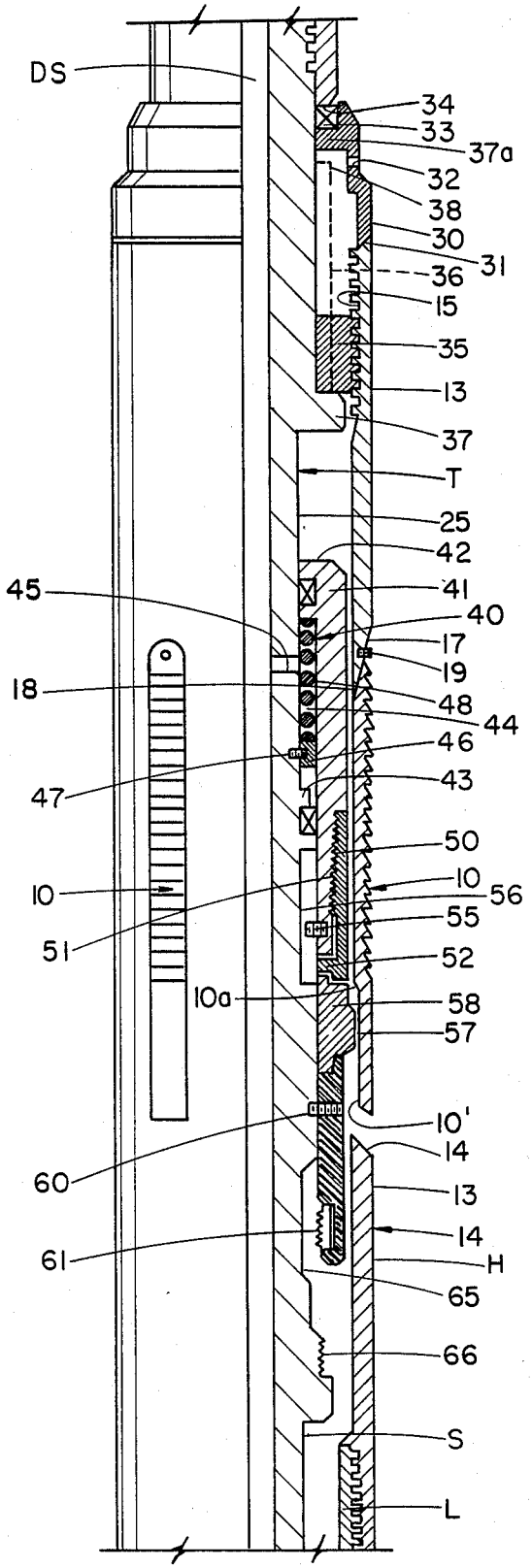
FIG. 1 is a view in partial longitudinal cross-section of a liner hanger and setting tool which can be utilized with the present invention.

Referring now to FIG. 1, a liner L is coupled to a liner hanger H which has circumferentially disposed slip elements or slips 10 for gripping engagement with a well casing. The slip elements 10 are normally disposed within the outer wall of the liner hanger so that the slips do not project outwardly of the circumferential outer surface of the liner hanger H. The slip elements or slips 10 are movable radially outward to bring outer serrated surfaces of the slips into gripping engagement with the inner wall of a well casing. The liner hanger and liner are releasably connected t a setting tool T which, in turn, is connected to a work or drill string DS. Thus, the work string can be used to lower and manipulate the liner and liner hanger prior to setting the liner.

The liner Hanger H includes a tubular outer member 13 which has elongated, circumferentially spaced slip slots 14 (See FIG. 1) and is attachable at its lower end to a liner. At the upper end of the outer member 13 is a internal left-hand thread 15. The side edges of the slips 10 and the side edges of the slots 14 have sliding, inclined tongue and groove connections (not shown) which provide for sliding movement between the contracted unset position shown and an extended position in engagement with the wall of a well casing. At the upper end of each slot 14 is an inclined surface 17. A complimentarily inclined surface 18 on a slip is arranged to move parallel to the surface 17. Surfaces 17 and 18 may be in sliding contact or may be separated from one another as the tongue and groove slots provide the appropriate expander sliding and load supporting surfaces. The inclined surface 17 and keyed tongue and groove slots constitute expander means for a slip member. A shear pin 19 is disposed on the inclined surface 17 to releasably retain a slip in a retracted position.

The setting tool T includes a tubular inner member 25 which is attachable at its upper end to a drill string DS and attachable at its lower end to a drill string "S". The inner member 25 carries a bearing housing 30, a release nut 35 and a unitary hydraulic-mechanical actuator means 40. The bearing housing 30 has a lower end 31 adapted to engage the upper end of the outer member 13. The housing 30 has a number of bypass ports 32. The upper end of the housing 30 contains a rotational thrust bearing 33. The rotational thrust bearing 33 on the housing 30 is engagable with a downwardly facing shoulder 34. The housing 30 includes a flange 37*a* below the bearing 33. The flange 37*a* and bearing 33 are disposed between the downwardly facing shoulder 34 and an upwardly facing shoulder 38 on the inner member 25. Below the shoulder 38, the inner member 25 has a section of noncircular cross-section forming splines 36 which slidably and non-rotatively receive a non-circular bore in the release nut 35. The release nut 35 has external left-hand threads which threadably and releasably engage with the internal threads 15 in the outer member 13. The release nut 35 and threads 15 define interconnecting means for releasably interconnecting the inner and outer members. Below the nut 35, the inner member 25 has the flange 37 which supports the nut 35 and hence the liner on the inner member 25. Below the flange 37 is the unitry hydraulic-mechanical actuator means 40 which includes an outer actuator sleeve member 41 slidably mounted on the inner member 25. The sleeve member 41 has inwardly facing flange 42 with a sealing means bearing against the inner member 25 and the inner member 25 has an outwardly facing flange 43 with a sealing means bearing against the inner wall of the sleeve member 41. Between the flanges 42 and 43, an annular chamber 44 is defined and a port 45 provides fluid access from the bore of the inner member 25 to the annular chamber 44. Near the lower end of annular chamber 44 an annular stop ring 46 is connected by a shear pin 47 to the inner member 25. Between the stop ring 46 and the upper flange 42 is a spring 48 under compression.

The structure defining the annular chamber 44 defines a hydraulic-mechanical actuator means which is movable between contracted and expanded positions.

At the lower end of the sleeve member 41 is an externally threaded section 50 which engages with a threaded section 51 on a tubular dog collar 52. The lower end of the sleeve member 41 also has a pin member 55 which is slidably received in a longitudinal guide or key slot 56 in the inner member 25. The sections 50 and 51, when released from a threaded interconnection, permit the sleeve member 41 to be moved upwardly by the spring 48. The releasable connection thread 15 in the outer member 13 is made with a greater number of threads than the number of threads on threaded section 51. In practice, twenty turns or rotations are required to release the nut 35 while thirteen turns or rotations of the drill string are required to release the thread 51.

The dog collar 52 has rectangular slots 57 which slidably receive rectangular dog members 58. The dog members 58 have ears, on a base portion projecting beyond the opening of a slot 57 so that a dog member 58 cannot fall out of a slot. The ends of the dog members 58 which project outwardly from the dog collar 52 have inwardly tapered surfaces and are disposed in a recess 10' in the lower end of a slip 10.

In the lower end of the dog collar 52 a shear pin 60 releasably connects the dog collar 52 to the inner member 25. At the lower end of the dog collar 52 is a resilient annular ratchet ring 61 with internal ratchet teeth. The ring 61 is contained in an internal recess in the end of the dog collar 52. The dog collar 52 defines slip actuator means for moving the slip means in response to the hydraulic-mechanical actuator means. The shear pin 60 is a release means for holding the actuator means in a contracted position while the spring is compressed.

In the position shown, the inner member 25 has an unlocking recess 65 and an external annular ratchet 66 at its lower end. The recess 65 and ratchet 66 are arranged so that when the ratchet 66 engages the ratchet ring 61, the recess 65 is disposed under the dog members 58.

In the operation of the tool, the hanger slips 10 can be set either mechanically or hydraulically. For hydraulic setting, the liner, liner hanger, setting tool and drill string are lowered to the level in the borehole or casing where the hanger is to be set. A sealing ball (not shown) is dropped through the drill string to a ball check valve 68 (FIG. 2) which is in the lower end of the setting tool. By pressuring up on the fluid in the drill string, pressure in the annular chamber 44 shears the pin 60 first and then the hydraulic force on the sleeve member 41 (as well as the spring force) moves the dogs 58 upwardly engaging the lower end of the slips 10. The shear pin 19 for a slip 10 is sheared and the slips are moved outwardly along the inclined surfaces 17 to engage the well casing for supporting the weight of the liner. The drill string is lowered and right hand rotation of the drill string unthreads the nut 35 from the outer member 13. At the same time the sleeve member 41 unscrews from the dog collar 52 (at the threaded connection 50 and 51) so that the inner member can be disengaged from the outer member 13. Upon moving the drill string upwardly, the ratchet 66 on the inner member 25 engages the ratchet ring 61 and the recess 65 permits the dogs 58 to be released and moved inwardly from the slips so that the dogs are locked in position relative to the recess 65. The entire setting tool assembly is retrieved leaving only the slips and the liner hanger in the casing.

To set the hanger mechanically, the liner is brought into engagement with the bottom of a well bore so that the inner member 25 can be rotated relative to the outer member 13. By rotating the drill string, the shear pin 60 is sheared and the spring 48 moves the sleeve element 41 and dog member 52 upwardly. The spring force of the spring 48 causes the dogs 58 to be moved to a position in engagement with the slip shoulder 10*a*. Upon lifting the drill string in an upward direction, the flange 37 below the nut 35 contacts the nut 35. Continued upward pull on the drill string shears the shear pin 19 and releases the slips 10. The drill string then is used to move the liner to the desired location while the slips are dragged along the well bore surface and are being pushed outwardly by the spring force only. At the desired location for hanging the liner, the drill string is lowered thus setting the slips 10 and hanging the liner in a well casing. Next, the drill string is lowered and the nut cover 30 is in engagement with the outer member 13 so that rotation of the drill string releases the nut 35 and the setting tool from the outer member 13 of the liner hanger. At this time, the inner member 25 can be raised so that the ratchet 66 engages the ratchet ring 61 and the release groove or recess 65 releases the dogs 58 from the slip elements.

The foregoing tool as described in FIG. 1 (other than the check ball valve 68) is more completely described in U.S. Pat. No. 4,712,614, issued Dec. 15, 1987 to Roger Allwin and Mark Budke.

Figure 2:
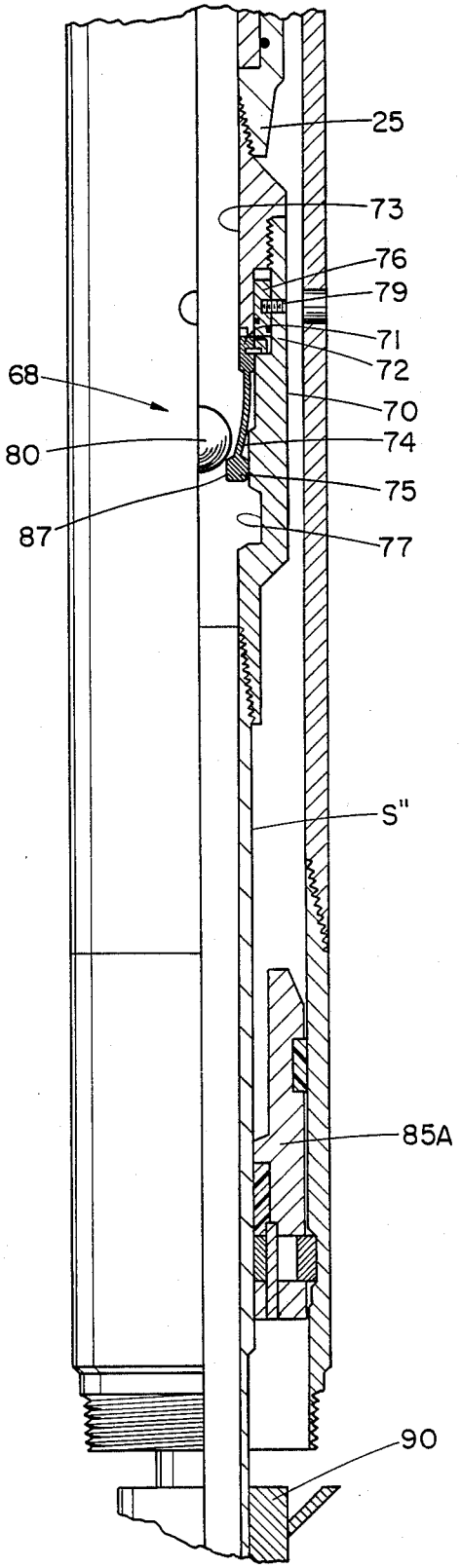
FIG. 2 is a view in partial longitudinal cross-section of a ball seat in a contracted condition.
Figure 4:
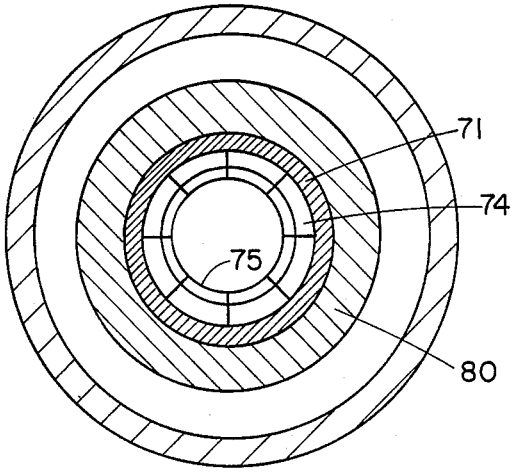
FIG. 4 is a partial view taken along line 4—4 of FIG. 3.

Referring now to FIG. 2, a lower end of the hydraulically operated setting tool is illustrated with a ball valve seat 68 which shows an embodiment of the present invention. A tubular sub 70 coupled to the setting tool mandrel (inner member 25) has a bore which slidably receives a tubular valve body sleeve 71. The valve body sleeve 71 is attached by an expandable retainer means 72 to a piston 76 in the sub 70. The bore of the valve body sleeve 71 is sized to form a continuation of the bore 73 of the setting tool mandrel. Depending from the valve body sleeve 71 are circumferentially spaced collet type finger members 74 with enlarged terminal projection members 75. The finger members, for example, can be 12" long which gives good resiliency and a small ball valve seat. The projection members 75 and the finger members 74 in the position shown (see also FIG. 4) are contracted relative to the bore 73 to form a ball valve seat for a pressure ball 80. The finger members 74 in the position shown are resiliently biased. That is, the finger members 74, if unconfined, would normally spring radially outward. When a sealing ball 80 is positioned in the reduced bore 87 formed by the contracted terminal projection members 75 and the finger members 74, a hydraulic pressure buildup can be obtained in the drill pipe.

The valve body sleeve 71 is held in an upper position by a resilient snap ring 72. The snap ring is held in a contracted position in the valve body sleeve 71 by a piston 76. When pressure is applied to a ball 80 in the ball valve seat, the piston 76 moves upwardly shearing a shear pin 79 and releasing the contracting force on the snap ring 72. The snap ring 72 remains in place under applied pressure until the pressure is reduced. When the pressure is reduced, the snap ring 72 expands and disconnects from the valve body sleeve 71. When the snap ring 72 expands, the valve body sleeve 71 is displaced downwardly to position the enlarged terminal projection members 75 adjacent to an annular recess 77 in the sub 70. In this position the projection members can expand into the recess 77 and the ball 80 is then released to pass through the finger members 74 so that the interior of the drill pipe becomes a full bore passage through the body sleeve 71, the finger members 74 and the projection members 75. Thus, a cementing plug can easily pass through the sleeve assembly as described and the release of the ball member 80 will not prematurely actuate the wiper plug 90.

In the section of drill pipe S" just below the sleeve 71 there is a pack-off sealing means 85A for sealing the drill pipe S" on the setting tool with respect to the liner. This apparatus is illustrated in U.S. Pat. No. Re. 31,881. Sealing means 85A could be a cup type seal means, if desired. Below the sealing means 85A is a conventional liner wiper plug 790 for receiving a cementing plug.

Figure 3:
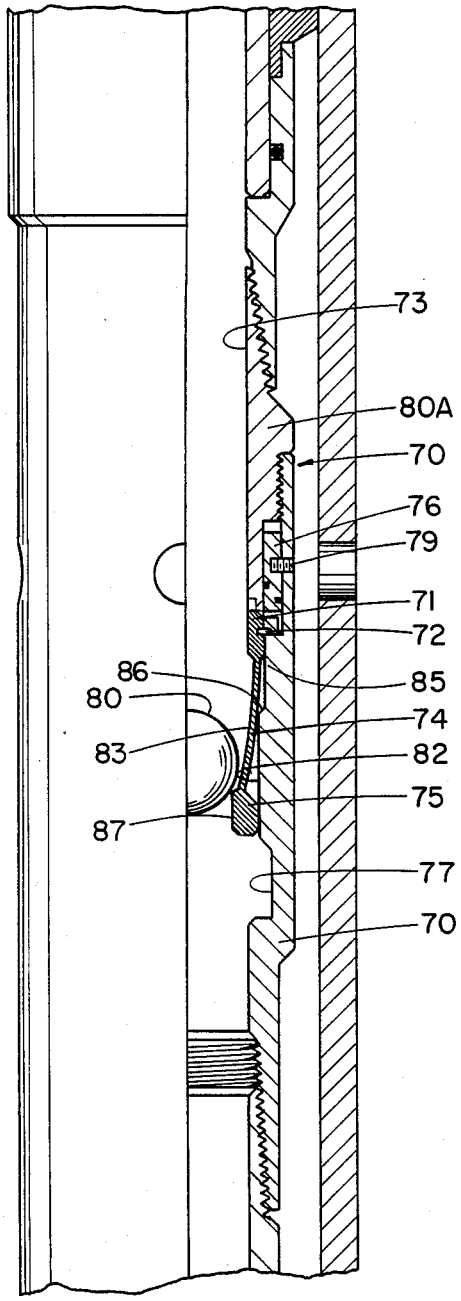
FIG. 3 is an enlarged view in partial cross-section illustrating a ball valve seat in accord with the present invention.
Figure 5:
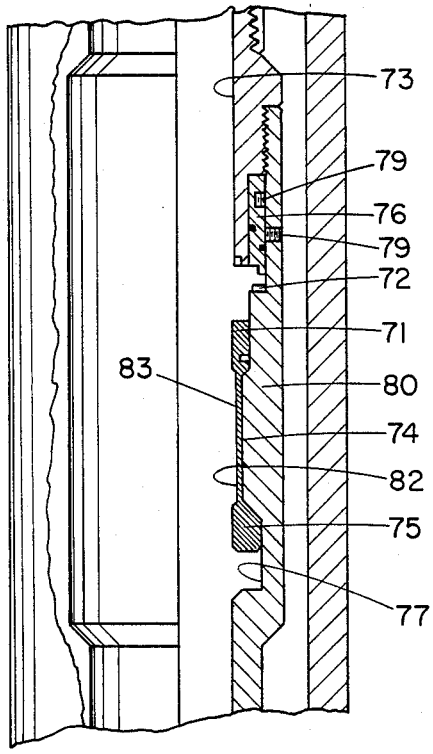
FIG. 5 is a view in partial longitudinal cross-section illustrating the ball seat valve in an expanded position.

As shown in enlarged detail in FIG. 3, the tubular sub member 70 has a threaded pin and socket interconnection with a tubular member 80A. Disposed between the interconnecting parts of the members 70 and 80A is annular piston 76 which is fixed in position by a shear pin 79 and is provided with inner and outer pressure seals. The piston 76 has a lower, annular internal recess to hold an annular snap ring 72 in resiliently contracted condition in an external groove in the tubular sleeve body member 71. The tubular sleeve body member 71 is releasably held in an initial position by the snap ring 72 as illustrated but is movable to a lower position as shown in FIG. 5 where a downwardly facing shoulder 85 on the sleeve body member engages an upwardly facing shoulder 86 on the sub member 70. This engagement limits the downward travel of the sleeve body member 71 relative to the sub member 70. The tubular sleeve body member 71 has an annular ring portion connected to depending, lengthwise extending finger members 74 which terminate with segmental, thickened projection members 75. The finger members 74 are formed by circumferentially located longitudinal slots. A projection member 75 extends inwardly and outwardly to either side of an attached finger member 74. When a ball 80 is in the seat and pressure is applied, the piston 76 is moved by pressure and shears the pin 79. Movement of the piston 76 removes an annular barrier from behind the snap ring 72. When the pressure is reduced, the snap ring 72 expands and releases the body member 71. When the snap ring 72 is released, the sleeve body member 71 will move downwardly to a position as shown in FIG. 5. As shown in FIG. 5, the finger members 74 will resiliently urge the projection members 75 outwardly into the annular groove 77 in the sub member 70. The bore 82 in the sub member 70 between the shoulder 86 and the recess 77 is enlarged so that the inner surfaces 83 of the finger member 74 and the inner surfaces 87 of the projections define a bore diameter which is functionally sufficient to utilize a cementing plug. Thus the bore diameter is preferably the same or a larger diameter than the bore diameter of the bore 73 thereby making the bore through the valve member full opening. The purpose of the device is to selectively catch a smaller diameter ball for closing the bore to set the hydraulic setting tool. When the setting tool is actuated, the ball is released and the bore of the valve seat is enlarged to a diameter dimension so that the size of the bore does not affect subsequent use of a cementing plug which must pass through the valve seat opening to seat in a wiper plug.

As noted heretofore the valve sleeve is a part of the setting tool and can be retrieved with the setting tool and does not require an expendable or non-returnable downhole valve seat sub which is a considerable savings in the cost of equipment for a job. In addition, by locating the valve seat in the setting tool, the problem of locating a valve ball or plug member in a deviated bottom hole location is eliminated. Also it is not necessary to pressure up the length of the liner to operate the setting tool which has an advantage in eliminating concern over rupture or other problems with the liner which can occur under hydraulic pressure conditions.

It will be apparent to those skilled in the art that various changes may be made in the invention without departing from the spirit and scope thereof and therefore the invention is not limited by that which is enclosed in the drawings and specifications, but only as indicated in the appended claims.

We claim:

1. A hydraulic operated setting tool for hanging well liners in a well bore where the setting tool is used on a string of pipe and is actuated by hydraulic pressure in the string of pipe, comprising:

hydraulic means in said setting tool, said hydraulic means being responsive to hydraulic pressure in said setting tool for producing an actuating motion in said setting tool;

an outer tubular member located in said setting tool at a location below said hydraulic means, an inner tubular member mounted for relative movement in said outer tubular member between first and second longitudinal positions, said inner tubular member having depending resilient finger members terminating with end members, said end members and said outer tubular member in said first longitudinal position cooperating for holding said end members inwardly in a contracted position to form a valve seat within said inner tubular member for receiving a closure member and for permitting buildup of hydraulic pressure in said setting tool for operation of said hydraulic means;

release means for releasably interconnecting said inner tubular member to said outer tubular member in said first longitudinal position, said release means including (1) an annular groove in said inner member, (2) an expandable ring member disposed in a contracted condition in said annular groove and in abutting contact with said outer tubular member in said first longitudinal position, (3) pressure responsive means in an initial position in said outer tubular member for initially releasably retaining said expendable ring member in said contracted condition in said first longitudinal position, and (4) shear means initially releasably holding said pressure responsive means in the initial position for releasably retaining said resilient ring member in said contracted condition;

said pressure responsive means being movable from the initial position upon the buildup of hydraulic pressure in said setting tool to another position for release of said expandable ring member in said annular groove whereby said expandable ring member can expand from the annular groove in said inner member into said outer tubular member upon reduction of the hydraulic pressure in said setting tool;

said outer tubular member having an annular recess located longitudinally relative to the location of said end members in said first longitudinal position so that when said expandable ring member expands into said outer tubular member that the inner tubular member is selectively movable to said second longitudinal position, said end members being movable outwardly into said annular recess in said second longitudinal position to an expanded position where said end member release a closure member from the valve seat.

2. The setting tool as set forth in claim 1 wherein said end members in said contracted position have adjacent side surfaces arranged to contact one another and inner surfaces which define a circular bore.

3. The setting tool as set forth in claim 1 wherein said end members, when disposed in said annular recess, define a full opening bore through said inner tubular member.

4. A method for operating a hydraulic operated setting tool for hanging a well liner in a well bore where the setting tool is located in a well bore by a string of pipe and is actuated by hydraulic pressure and includes hydraulic means responsive to hydraulic pressure for producing an actuating motion in said setting tool and where an inner tubular valve sleeve is located in an outer tubular member of said setting tool at a location below said hydraulic means and where said inner tubular valve sleeve is slidably mounted for relative movement between first and second longitudinal positions in said outer tubular member and where end members on the inner tubular valve sleeve normally extend radially inwardly to a contracted position for defining a contracted valve seat in the inner tubular valve sleeve in the first longitudinal position for receiving a closure member to close off said valve seat, and where a release of said inner tubular valve sleeve from said first longitudinal position can be controlled by hydraulic pressure applied to the setting tool to permit movement of said inner tubular valve sleeve to the second longitudinal position where the end member forming the valve seat expand into a recess in said outer tubular member, the method comprising the steps of:

dropping a closure member into the contracted valve seat in the inner tubular valve sleeve for closing off the valve seat;

applying first hydraulic pressure to said setting tool and said closed off valve seat for developing pressure for actuating said hydraulic means in setting tool and for holding said tubular valve sleeve on a releasable and expandable ring means which interconnects said inner tubular valve sleeve and said outer tubular member while said first hydraulic pressure is applied;

reducing said first hydraulic pressure to a second lower hydraulic pressure on said closed off valve seat for permitting release of said expandable ring means from interconnecting with said inner tubular valve sleeve thereby releasing said inner tubular valve sleeve relative to said outer tubular member for permitting movement of said inner tubular valve sleeve to said second longitudinal position; and using said second reduced hydraulic pressure for moving said inner tubular valve sleeve downwardly with said closure member to said second longitudinal position where the end members forming the valve seat expand into the recess in the outer tubular member while releasing the closure member so that the inner tubular valve sleeve is retrievable with said setting tool.

5. The method as set forth in claim 4 wherein the step of applying first hydraulic pressure includes moving a retainer member in the outer tubular member where the retainer member normally holds the expandable ring means in position in the inner tubular member so that the expandable ring means is free to expand from said inner tubular member into said outer tubular member upon moving of the retainer member thereby releasing said inner tubular valve sleeve from said outer tubular member.

* * * * *